United States Patent [19]

Hyland et al.

[11] Patent Number: 4,784,921

[45] Date of Patent: Nov. 15, 1988

[54] ALUMINUM ALLOY AUTOMOTIVE MATERIAL

[75] Inventors: M. E. Hyland, Forest Hills; Warren H. Hunt, Jr., Monroeville, both of Pa.

[73] Assignee: Aluminum Company of America, Pittsburgh, Pa.

[21] Appl. No.: 66,953

[22] Filed: Jun. 29, 1987

Related U.S. Application Data

[63] Continuation-in-part of Ser. No. 794,467, Nov. 4, 1985.

[51] Int. Cl.[4] ..... B32B 15/20

[52] U.S. Cl. ..... 428/654; 148/12.7 A; 148/417; 148/439; 420/534

[58] Field of Search ..... 148/12.7 A, 2, 417, 148/439; 420/534; 428/654

[56] References Cited

U.S. PATENT DOCUMENTS 4,589,932 5/1986 Park ..... 148/12.7 A

*Primary Examiner*—R. Dean

*Attorney, Agent, or Firm*—Andrew Alexander

[57] ABSTRACT

Aluminum alloy products particularly for automotive applications, e.g. panel members, may be produced from a body of aluminum base alloy consisting essentially of, by weight, 0.5 to 0.85% Si, 0.25 to 0.48% Mg, 0.05 to 0.4% Fe, 0.75 to 1.1% Cu, 0.1 to 0.5 wt. % Mn, the balance essentially aluminum and incidental elements and impurities. The alloy body may be homogenized at a temperature in the range 900° to 1100° F. and thereafter worked into a wrought product such as sheet which may be continuously solution heat treated and quenched and aged to a T4 condition prior to forming into vehicular panel members, for example.

40 Claims, No Drawings

ALUMINUM ALLOY AUTOMOTIVE MATERIAL

CROSS REFERENCE TO RELATED APPLICATIONS

This application is a continuation-in-part of U.S. Ser. No. 794,467, filed Nov. 4, 1987.

BACKGROUND OF THE INVENTION

This invention relates to improved vehicular body panels and structural members suitable for use on automobiles and other vehicles and to methods for producing the same.

Because of the increasing emphasis on producing lower weight automobiles in order, among other things, to conserve energy, considerable effort has been directed toward developing aluminum alloy products suited to automotive application. Especially desirable would be a single aluminum alloy product useful in several different automotive applications. Such would offer scrap reclamation advantages in addition to the obvious economies in simplifying metal inventories.

To serve in a wide number of automotive applications, an aluminum alloy product needs to possess good forming characteristics to facilitate shaping, bending and the like, without cracking, tearing, lueders' lines or excessive wrinkling or press loads, and yet be possessed of adequate strength. Since forming is typically carried out at room temperature, formability at room or low temperatures is often of principal concern. In addition, the alloy should have high bending capability without cracking or exhibiting orange peel, since often the structural products are fastened or joined to each other by hemming or seaming.

Various aluminum alloys and sheet products thereof have been considered for automotive applications, including both heat treatable and non-heat treatable alloys. Heat treatable alloys offer an advantage in that they can be produced at a given lower strength level in the solution treated and quenched temper which can be later increased by artificial aging after the panel is shaped. This offers easier forming at a lower strength level which is thereafter increased for the end use. Further, the thermal treatment to effect artificial aging can sometimes be achieved during a paint bake treatment, so that a separate step for the strengthening treatment is not required. Non-heat treatable alloys, on the other hand, are typically strengthened by strain hardening, as by cold rolling. These strain or work hardening effects are usually diminished during thermal exposures such as paint bake or cure cycles, which can partially anneal or relax the strain hardening effects.

One heat treatable alloy sheet product which has been considered is alloy 6151 (referring to the Aluminum Association registration number) whose registered composition range is, by weight, 0.6 to 1.2% Si, 0.45 to 0.8% Mg, 0.15 to 0.35% Cr, balance aluminum, with maximum limits on other elements as follows: 1.0% Fe, 0.35% Cu, 0.20% Mn and 0.25% Zn. However, using a sheet product of typical composition for alloy 6151 containing 0.85% Si, 0.56% Mg, 0.19% Cr, 0.48% Fe, 0.19% Cu, 0.20% Zn and 0.04% Ti, numerous problems were encountered, as forming attempts were hampered by cracking and the desired combinations of strength and formability were not realized.

Two other aluminum alloy sheet products have been given serious consideration for use in automotive applications, namely, alloys 2036 and 5182, and, in fact, both have seen limited use. Alloy 2036 is a heat treatable alloy containing 2.2 to 3.0% Cu, 0.10 to 0.40% Mn, 0.30 to 0.60% Mg and a maximum of 0.50% each for both Si and Fe as impurities, the remainder aluminum. It was used in the outer panel mainly because it had a yield strength of about 27 to 28 ksi which is comparable to that of steel, thus providing dent resistance similar to steel. Alloy 2036, however, is not possessed of sufficient workability to consistently form the more intricate shapes desired for some inner panel applications. Aluminum alloy 5182, a non-heat treatable alloy containing 4.0 to 5.0% Mg, 0.20 to 0.50% Mn, balance aluminum with, as impurities, maxima of 0.20% Si, 0.35% Fe, 0.15% Cu and 0.10% Cr and having a yield strength of about 17 ksi, was used for the inner support panel because of its high level of formability. However, it lacked sufficient strength and dent resistance to serve as the outer panel. Hence, the two alloy panel received considerable attention with the stronger and more dent resistant 2036 alloy serving as the outer panel and the more formable 5182 alloy serving as the inner panel. However, this particular two alloy system had several drawbacks. For example, during paint baking, the strength of the outer panel is only increased very slightly. Also, the baking can have an annealing effect on the inner support panel which for all practical purposes is a strain hardenable alloy. Thus, the baking can act to reduce the strength of the inner panel while only slightly increasing the strength of the outer panel, thereby sometimes weakening the overall dual panel structure.

Another alloy system useful for vehicular structural members and body panels is disclosed in U.S. Pat. No. 4,082,578 which discloses an aluminum base alloy consisting essentially of, by weight, 0.4 to 1.2% Si, 0.4 to 1.1% Mg, 0.1 to 0.6% Cu, 0.05 to 0.35% Fe, and at least one element from the group consisting of 0.2 to 0.8% Mn, 0.1 to 0.3% Cr and 0.05 to 0.15% Zr, the balance aluminum and incidental elements and impurities. This system provided alloys having improved levels of strength and formability over prior alloys.

Also, SAE Technical Paper 830096 entitled "An Optimized Aluminum Alloy (X6111) for Auto Body Sheet Applications" suggests an alloy for auto body sheet having 0.85% Si, 0.75% Cu, 0.20% Fe, 0.72% Mg and 0.20% Mn.

However, the Aluminum Association notes with respect to designing and producing tools in "Data on Aluminum Alloy Properties and Characteristics for Automotive Application", ANSI H35.1-1972, that if tools and parts are designed to form aluminum sheet satisfactorily, then steel sheet will form with no problem. But tooling designed for steel often will not produce satisfactory parts in aluminum. Thus, the use of aluminum alloy body panels in automotive applications normally necessitates redesigned tooling to form parts substantially identical to the comparable steel parts. This requirement, of course, is detrimental in that it is a serious obstacle with respect to the economics of using aluminum alloy body panels.

The present invention overcomes many of the prior art problems and provides aluminum base alloy products for deep drawn components which permit the forming of such into automotive components substantially identical to steel components formed in the same dies.

SUMMARY OF THE INVENTION

A principal object of the present invention is to provide aluminum alloy wrought products, particularly for fabrication into selected automotive or vehicular components.

A further object of the present invention is to provide aluminum alloy wrought products having high forming capabilities yet having high strength on aging so as to enable its use in automotive or vehicular body applications.

Another object of the present invention is to provide an aluminum alloy sheet product capable of being formed into deep drawn automotive components on dies designed for forming steel sheet to provide substantially identical shapes.

These and other objects will become apparent from a reading of the specification and claims and an inspection of the claims appended hereto.

In accordance with these objects, there is provided an alloy for vehicular panel members and other automotive applications. The alloy contains 0.5 to 0.85% Si, 0.25 to 0.55% Mg, 0.05 to 0.4% Fe, 0.75 to 1.0% Cu, 0.1 to 0.5 wt. % Mn, the balance essentially aluminum and incidental elements and impurities. The process of the invention includes homogenizing the alloy at a temperature in the range of 900° to 1100° F. and thereafter working the body to produce a wrought aluminum sheet product which may be later fabricated into automotive or vehicular components. The working step may be followed by solution heat treating and quenching to obtain sections suitable for the additional fabrication steps.

DETAILED DESCRIPTION OF THE PREFERRED EMBODIMENTS

As noted, the alloy of the present invention consists essentially of, by weight percent, 0.50 to 0.85% Si, 0.25 to 0.55% Mg, 0.05 to 0.40% Fe, 0.75 to 1.0% Cu, 0.1 to 0.5 wt. % Mn, the balance essentially aluminum and incidental impurities. The impurities are preferably controlled to provide not more than 0.2% Zn and 0.10% Ti, with not more than 0.05% of each Zn and Ti being preferred. Other impurities are preferably limited to about 0.05% each and the combination of other impurities preferably should not exceed 0.15%. Within these limits it is preferred that the sum total of all impurities does not exceed 0.35%.

With respect to the main alloying constituents, it is preferred that Si be in the range of 0.55 to 0.75%; Mg in the range of 0.3 to 0.45%; and Cu in the range of 0.85 to 1.0 and Mn in the range of 0.1 to 0.4 wt. % and Mg being less than Si on a wt. % basis. This preference is based on achieving a wide spread between the naturally aged forming temper and the artificially aged stronger temper.

It should be noted that it is desired to maximize the difference in strength levels between the fabricating temper and the final artificially aged temper of the present alloy system in order to alloy for the formability requirements and yet maintain high strength in the end product. This can be achieved in part by controlling the silicon and magnesium content within the guidelines set forth herein.

Iron contributes to or aids in grain size control and is present between a minimum of 0.05%, preferably 0.1% minimum, and a maximum of 0.4%, preferably 0.2% maximum. Grain size may be controlled more by process in the absence of effective amounts of elements such as Cr and Zr since their presence can act to hamper formability in the present invention.

With respect to grain size, sheet products produced in accordance with the invention preferably have a grain size of at least 15,000 grains/mm$^3$ or finer with a preferred grain size being at least 18,000 grains/mm$^3$ with typical grain sizes being in the range of 25,000 to 40,000 grains/mm$^3$.

As well as providing the alloy with controlled amounts of alloying elements as described herein, it is preferred that the alloy be prepared according to specific method steps in order to provide the most desirable characteristics. Thus, the alloy described herein can be provided as an ingot or billet for fabrication into a suitable wrought product by techniques currently employed in the art, with continuous casting being preferred. The cast ingot may be preliminarily worked or shaped to provide suitable stock for subsequent working operations. Prior to the principal working operations, the alloy stock is preferably subjected to homogenization, and preferably at metal temperatures in the range of 900° to 1100° F. for a time period of at least one hour in order to dissolve magnesium and silicon or other soluble elements, and homogenize the internal structure of the metal. A preferred time period is 2 hours or more in the homogenization temperature range. Normally, the heat up and homogenizing treatment does not have to extend for more than 24 hours; however, longer times are not normally detrimental. A time of 3 to 12 hours at the homogenization temperature has been found to be quite suitable. For example, a typical homogenization treatment is 4 hours at 1040° F. In addition to dissolving constituent to promote workability or formability, this homogenization treatment is important in that it is believed to coalesce any undissolved constituents such as those formed by iron and silicon which coalescence also aids in providing the present alloy with superior formability characteristics.

After the homogenizing treatment, the metal can be rolled or extruded or otherwise subjected to working operations to produce stock such as sheet or extrusions or other stock suitable for shaping into the end product. To produce a sheet-type product, a body of the alloy is preferably hot rolled to a thickness ranging from about 0.100 to about 0.16 or 0.2 inch, typically around 0.140 inch. For hot rolling purposes, the temperature should be in the range of 1050° down to 400° F. Preferably, the metal temperature initially is in the range of 800° to 1050° F. and the temperature at the completion is preferably 400° to 600° F.

When the intended use of a sheet product is for bumper or bumper back-up bar applications, normally operations other than hot rolling are unnecessary for this rather thick sheet of, typically, 0.100 to 0.250 inch. Where the intended use is body panels requiring a thinner gauge, further reduction as by cold rolling can be provided. Such reductions can be to body sheet thicknesses ranging, for example, from 0.019 to 0.077 inch, usually from 0.032 to 0.050 inch.

After rolling a body of the alloy to the desired thickness, the sheet is subjected to a solution heat treatment to substantially dissolve soluble elements. The solution heat treatment is preferably accomplished at a temperature in the range of 900° to 1100° F. and normally produces a recrystallized grain structure. It is preferred to use a solution heat treating temperature in the range of 1000° to 1070° F. as such facilitates achieving very good combinations of strength and formability.

Solution heat treatment in accordance with the present invention is required to be performed on a continuous basis, and the time at the heat treating temperature must be closely controlled so as to avoid grain growth which results in orange peel and reduced formability. Basically, solution effects can occur fairly rapidly, for instance in as little as one to ten seconds, once the metal has reached a solution temperature of about 900° to 1050° F. In continuous treating, the sheet is passed continuously as a single web through an elongated furnace which greatly increases the heat-up rate. The continuous approach is required in practicing the invention, especially for sheet products, since a relatively rapid heat-up and short dwell time at solution temperature result in maintaining a finer grain size. Accordingly, the inventors contemplate solution heat treating in as little as about 10 minutes, or less, for instance about 0.5 to 4 minutes, with times of about 1 to 2 minutes at the solution heat treating temperature being quite suitable. As a further aid to achieving a short heat-up time, a furnace temperature or a furnace zone temperature, significantly above the desired metal temperature provides a greater temperature head useful to speed heat-up times.

To further provide for the desired strength and formability necessary to the final product and to the operations in forming that product, the sheet should be rapidly quenched to prevent or minimize uncontrolled precipitation of $Mg_2Si$. Thus, it is preferred in the practice of the present invention that the quenching rate be at least 10° F./sec. from solution temperature to a temperature of about 350° F. or lower. A preferred quenching rate is at least 300° F./sec. in the temperature range of 750° F. or more to 550° F. or less. After the metal has reached a temperature of about 350° F., it may then be air cooled. Suitable rates can be obtained with a water quench, and preferably the quenching is performed on a continuous basis. By conforming to these controls, the sheet product can be easily formed into intricate parts on a highly consistent basis without cracking or exhibiting roughness such as orange peel both of which are obviously considered unacceptable, especially on outer panels in automotive applications.

The improved sheet and other wrought products produced as herein described have a range of yield strength of from around 12 to 30 ksi, typically 15 to 25 ksi, for sheet in the naturally aged condition following proper solution and quench treatments as described herein. The naturally aged condition is achieved without any added treatment and occurs naturally with the passage of time. There are two aspects of natural aging in the practice which make such particularly suited to use in automotive or vehicular body applications. One aspect is that a stable property level is reached relatively quickly, after about only 1 or 2 weeks, or perhaps a month at room temperature, wherein the strength levels off and remains substantially at or near a relatively constant level for many months, or even years. Another aspect is that this stable level of properties is characterized by strength and formability qualities particularly suited to automotive or vehicular body applications. The condition of naturally aged stable properties is termed the T4 temper.

Aluminum wrought products produced in accordance with the foregoing practice provide material having the strength and forming characteristics required to serve as automotive or vehicular body sheet. One test of formability is a bend test which relates formability, especially with respect to the hemming or seaming which is sometimes employed to join inner and outer automotive panels in a dual panel structure such as a door or hood. It will be noted that the bend can be 180° and the radius of curvature can be equivalent to half the thickness ($\frac{1}{2}$ T) of the metal. For example, the bend radius would be 0.02 inch for 0.04 inch thick sheet. Automotive body sheet should be capable of withstanding such 180°$-\frac{1}{2}$ T bends without cracking, crazing or other signs of failure or incipient failure. The cracking in the hemming operation not only weakens the structure comprising the outer panel and support panel, but is also generally considered unacceptable aesthetically and can necessitate additional work to fill in and finish the hem area.

Sheet or other wrought products produced in accordance herewith are relatively readily formed into shaped or contoured automotive panels or structural members. Such forming typically includes pressing or stamping between opposite mating dies. In the case of a bumper, an extrusion or relatively thick sheet is stamped to provide the longitudinal curvature. A wheel is formed by first forming a welded hoop from a sheet, further forming the hoop to provide the desired contour and the welding or riveting to the inside of the hoop of the radial spider member which is typically stamped from sheet. These forming operations are typically carried out at room temperature but can be effected at slightly elevated temperatures of up to around 200° or at the so-called warm forming temperatures of up to around 400° F. or perhaps 450° F. However, it is preferred in some instances to perform the forming at substantially room temperature meaning not over 150° or 200° F. in order to avoid inducing uncontrolled precipitation effects in the alloy member.

As noted earlier with respect to forming automotive panels, in the past, typically tooling designed for steel will not produce satisfactory parts in aluminum. That is, the aluminum will not form to produce a part which is identical in shape to a part formed out of steel. Aluminum alloy sheet produced in accordance with the present invention in the solution heat treated and quenched condition has the quality that it is capable of being formed in mild steel forming dies particularly for deep drawn parts to produce a product having a shape substantially identical to mild steel formed in the same dies. Examples of such deep drawn parts include inner panels on doors, which panels may have openings and raised portions which provide stiffness and are shown in U.S. Pat. No. 4,082,578, incorporated herein by reference.

In the T4 condition, the present alloy can have elongation values ranging from 26 to 31%. While the inventor does not wish to be bound to any theory of invention, it is believed that it is the combination of these high elongation values combined with the fine grain structure resulting from continuous solution heat treating that provides the unique formability of this material.

After forming the wrought aluminum sheet or other product into the automotive panel, the panel can be artificially aged. This can be accomplished by subjecting the shaped product to a temperature in the range of 225° to 500° F. for a sufficient period of time to provide the desired yield strength. That is, the shaped panel is capable of being artificially aged to a yield strength of at least 30 ksi. The period of time can run from 2 minutes to 100 hours. Preferably, artificial aging is accomplished by subjecting the formed product to a temperature in the range of 350° to 425° F. for a period of at least 25 minutes. A suitable practice contemplates an aging treatment of 25 minutes at a temperature of 375° to 400° F. The strength of the shaped panel members after artificial aging, referred to as the T6 temper, ranges from around 30 to about 55 ksi or more, depending on alloy content, which is about 10 or 15 to 20 or more ksi higher than the T4 level for a given composition.

An advantage of the present invention resides in the aging characteristics of the alloy products. For example, certain aluminum alloys are strain hardened, e.g. 5182, and in their application on an automobile are often subjected to temperatures in the range of 250° to 400° F. for curing or baking in the paint cycle, which temperature acts to provide an annealing effect, which can lower the strength of the metal. By comparison, the present alloy's strength is increased by such paint bake cycle which can be used instead of the artificial aging step referred to earlier, thus providing an economical advantage in addition to the strength advantage.

The present alloy is advantageous in another way. Because of the emphasis put on conserving energy resources, means other than welding for joining metals such as outer and inner panels has been given attention. Seaming or hemming the outer panel to the inner panel has received widespread use. However, to be adapted to such technique, the outer panel should have a sufficiently high level of bendability or formability to sustain the hemming which level is often lacking in certain aluminum alloy sheet products otherwise meeting the desired strength requirements. Some such alloys, while sustaining the seaming operation without cracking, can exhibit the orange peel effect referred to earlier, which is aesthetically undesirable. The present alloy in sheet form meets the requirements for seaming and has a bendability as measured by radius of curvature as low as ½ the thickness of the sheet in a 180° bend without exhibiting unacceptable roughening or orange peel effect. Thus, designs do not have to be compromised to work around this effect.

Th following example is still further illustrative of the invention.

EXAMPLE

An aluminum alloy consisting of, by weight, 0.60% Si, 0.35% Mg, 0.95% Cu, 0.14% Fe, 0.22% Mn, the balance essentially aluminum, was cast into ingot suitable for rolling. The ingot was homogenized in a furnace at a temperature of 1040° F. for 4 hours and then hot rolled into a sheet product about 0.14 inch thick which was cold rolled into a sheet thicknes of 0.040 inch. The sheet was solution heat treated at a temperature of 945° F. for 2 minutes and then cold water quenched to room temperature. Properties including transverse yield strength and formability of the sheet in the aforesaid condition followed by material aging to a step property level referred to as the T4 temper are set forth in the Table. For purposes of artificial aging, the sheet was treated for one hour at a temperature of 400° F. to increase its strength. The properties of the sheet in this condition referred to as the T62 temper are also listed in the Table. The yield strength and elongation values for sheet products referred to herein are typically based on specimens taken in the transverse direction, the direction across a sheet and normal to the direction of rolling.

TABLE

| | Sheet A | |
|---|---|---|
| Temper | T4 | T62 |
| Yield Strength | 1.77 | 35.8 |
| Tensile Strength | 37.3 | 43.5 |
| Formability | 22.9% | — |
| Bendability | 0.2 r/t | — |
| Elongation (%) | 27.8 | 12.5 |

From this example it can be seen that the sheet, in accordance with the invention, provides a high degree of formability as measured by uniform elongation.

While the invention has been described in terms of preferred embodiments, the claims appended hereto are intended to encompass other embodiments which fall within the spirit of the invention.

What is claimed is:

1. A method of producing a vehicular structural member, comprising the steps of:

(a) providing a body of aluminum base alloy consisting essentially of 0.5 to 0.85% Si, 0.25 to 0.48% Mg, 0.05 to 0.40% Fe, 0.7 to 1.1% Cu, 0.1 to 0.5 wt. % Mn, the balance essentially aluminum and incidental elements and impurities;

(b) working said body to produce a wrought aluminum sheet product;

(c) solution heat treating said wrought sheet aluminum product on a continuous basis at a temperature within the range of 900° to 1100° F. in order to produce a structure having a fine grain size;

(d) quenching said sheet product;

(e) aging said sheet product to a condition having a substantially stable level of mechanical properties to provide a solution heat treated, quenched and aged product having a 26 to 31% elongation, a yield strength in the range of 12 to 30 ksi, and capable of being formed in mild steel forming dies to produce a deep drawn product having a shape substantially identical to mild steel formed in said dies; and (f) forming said aged product in said condition into said structural member.

2. The method in accordance with claim 1 wherein Si is in the range of 0.55 to 0.75 wt. %.

3. The method in accordance with claim 1 wherein Mg is in the range of 0.3 to 0.45 wt. %.

4. The method in accordance with claim 1 wherein Cu is in the range of 0.85 to 1.0 wt. %.

5. The method in accordance with claim 1 wherein Fe is in the range of 0.1 to 0.4 wt. %.

6. The method in accordance with claim 1 wherein said product in said step (e) is naturally aged to a T4 condition and is formed in said T4 condition into said structural member which is heated to a temperature of 225° to 500° F., thereby increasing the strength thereof.

7. The method in accordance with claim 1 wherein the solution heat treating is performed in less than four minutes.

8. The method in accordance with claim 1 wherein the solution heat treating is performed in less than two minutes.

9. A method of producing a vehicular structural member, comprising the steps of:

(a) providing a body of aluminum base alloy consisting essentially of 0.55 to 0.75% Si, 0.3 to 0.45% Mg, 0.05 to 0.40% Fe, 0.85 to 1.0% Cu, 0.1 to 0.5 wt. % Mn, the balance essentially aluminum and incidental elements and impurities;

(b) working said body to produce a wrought aluminum sheet product;

(c) solution heat treating said wrought sheet aluminum product on a continuous basis for a period of less than two minutes at a temperature within the range of 900° to 1100° F. in order to produce a structure having a fine grain size;

(d) quenching said sheet product;

(e) naturally aging said sheet product to a T4 condition to provide a solution heat treated, quenched and aged product having a 26 to 31% elongation, a yield strength in the range of 12 to 35 ksi, and capable of being formed in mild steel forming dies to produce a deep drawn product having a shape substantially identical to mild steel formed in said dies; and (f) forming said aged product in said T4 condition into said structural member and artificially aging said product at a temperature of 225° to 500° F., thereby increasing its strength.

10. The method in accordance with claim 9 wherein the fine grain size is at least 15,000 grains per cubic millimeter.

11. The method in accordance with claim 9 wherein said structural member has a heat curable coating thereon, and the heating in said step (f) of said claim 9 cures the coating as well as strengthens the structural member.

12. The method in accordance with claim 9 wherein the product is a sheet product having a thickness of 0.1 to 0.2 inch.

13. The method in accordance with claim 9 including hot rolling said body into a sheet product at a temperature in the rang of 400° to 1050° F.

14. The method in accordance with claim 9 wherein solution heat treating is performed at a temperature in the range of 900° to 1000° F.

15. The method in accordance with claim 9 wherein Fe is in the range of 0.05 to 0.2 wt. %.

16. A method of producing a plural panel vehicular structural member having spaced generally parallel inner and outer panels connected along peripheral portions thereof comprising the steps of:

(a) providing a body of aluminum base alloy consisting essentially of 0.5 to 0.85% Si, 0.25 to 0.55% Mg, 0.05 to 0.40% Fe, 0.75 to 1.0% Cu, 0.1 to 0.4 wt. % Mn, the balance essentially aluminum and incidental elements and impurities;

(b) homogenizing said body at a temperature in the range of 900° to 1100° F.;

(c) hot rolling said body to produce a hot rolled sheet;

(d) cold rolling said hot rolled sheet to provide a cold rolled sheet ranging in thickness between 0.019 and 0.077 inch;

(e) solution heat treating said cold rolled sheet at a temperature within the range of 900° to 1100° F.;

(f) quenching said sheet;

(g) aging said sheet product to a condition having a substantially stable level of mechanical properties to provide a solution heat treated, quenched and aged product having a 26 to 31% elongation, a yield strength in the range of 12 to 35 ksi, and capable of being formed in mild steel forming dies to produce a deep drawn product having a shape substantially identical to mild steel formed in said dies;

(h) forming a portion of such aged sheet product substantially at room temperature into an outer panel member by operations including stamping;

(i) forming a further portion of such aged sheet product substantially at room temperature into an inner panel by operations including deep drawing in mild steel forming dies to produce a panel having raised and recessed portions imparting flexural stiffness thereto;

(j) connecting said inner and outer panels together at peripheral portions thereof to provide a plural panel vehicular structural member;

(k) applying a heat curable coating to at least one surface portion of said automotive structure; and (l) heating said vehicular structure to a temperature of 225° to 500° F. to cure said coating and to increase the strength of said plural panel vehicular structure.

17. The method in accordance with claim 9 wherein said panels are connected by hemming the same together.

18. In a method of producing a sheet product for forming into vehicular structural members wherein an aluminum alloy product is formed to produce said sheet, the improvement wherein said sheet is provided as an alloy consisting essentially of 0.5 to 0.85% Si, 0.25 to 0.48% Mg, 0.05 to 0.40% Fe, 0.75 to 1.0% Cu, 0.1 to 0.5 wt. % Mn, the balance essentially aluminum and incidental elements and impurities, said sheet further being provided in the condition resulting from:

(a) working said body to produce a wrought aluminum sheet product;

(b) solution heat treating said wrought sheet aluminum product on a continuous basis at a temperature within the range of 900° to 1100° F. in order to produce a structure having a fine grain size;

(c) quenching said sheet product; and (d) aging said sheet product to a condition having a substantially stable level of mechanical properties to provide a solution heat treated, quenched and aged product having a 26 to 31% elongation, a yield strength in the range of 12 to 35 ksi, and capable of being formed in mild steel forming dies to produce a deep drawn product having a shape substantially identical to mild steel formed in said dies.

19. In the method in accordance with claim 18 wherein said working of said body includes rolling into a sheet product having a thickness in the range of 0.10 to 0.25 inch.

20. In the method of producing a vehicular panel wherein an aluminum alloy product is formed to produce said panel, the improvement wherein said product is provided as an alloy consisting essentially of 0.5 to 0.85 wt. % Si, 0.25 to 0.48 wt. % Mg, 0.05 to 0.40 wt. % Fe, 0.75 to 1.0 wt. % Cu, 0.1 to 0.4 wt. % Mn, the balance essentially aluminum and incidental elements and impurities, said product further being provided in the condition resulting from:

(a) homogenizing a body of said alloy at a temperature in the range of 900° to 1100° F.;

(b) hot rolling said body to produce a hot rolled sheet having a thickness in the range of 0.10 to 0.25 inch;

(c) cold rolling said hot rolled sheet to provide a cold rolled sheet having a thickness in the range of 0.019 to 0.077 inch;

(d) continuously heat treating said cold rolled sheet at a temperature in the range of 900° to 1100° F.;

(e) quenching said sheet at a rate of at least 10° F./sec. to a temperature of 350° F. or less; and (f) aging said sheet product to a condition having a substantially stable level of mechanical properties to provide a solution heat treated, quenched and aged product having a 26 to 31% elongation, a yield strength in the range of 12 to 35 ksi, and capable of being formed in mild steel forming dies to produce a deep drawn product having a shape substantially identical to mild steel formed in said dies.

21. An alloy for vehicular structural members consisting essentially of 0.5 to 0.85% Si, 0.25 to 0.48% Mg, 0.05 to 0.40% Fe, 0.7 to 1.1% Cu, 0.1 to 0.4 wt. % Mn, the balance essentially aluminum and incidental elements and impurities.

22. An alloy in accordance with claim 21 wherein Si is in the range of 0.55 to 0.75 wt. %.

23. An alloy in accordance with claim 21 wherein Mg is in the range of 0.3 to 0.45 wt. %.

24. An alloy in accordance with claim 21 wherein Cu is in the range of 0.85 to 1.0 wt. %.

25. An alloy in accordance with claim 21 wherein Fe is in the range of 0.1 to 0.4 wt. %.

26. An alloy in accordance with claim 21 wherein Fe is in the range of 0.05 to 0.2 wt. %.

27. A vehicular member comprised of aluminum base alloys consisting essentially of 0.5 to 0.85% Si, 0.25 to 0.55% Mg, 0.05 to 0.40% Fe, 0.7 to 1.1% Cu, 0.1 to 0.5 wt. % Mn, the balance essentially aluminum and incidental elements and impurities.

28. An alloy in accordance with claim 27 wherein Si is in the range of 0.55 to 0.75 wt. %.

29. An alloy in accordance with claim 27 wherein Mg is in the range of 0.3 to 0.45 wt. %.

30. An alloy in accordance with claim 27 wherein Cu is in the range of 0.85 to 1.0 wt. %.

31. A sheet product suitable for fabricating into vehicular panel members, the sheet product comprised of an aluminum base alloy consisting essentially of 0.5 to 0.85% Si, 0.25 to 0.48% Mg, 0.05 to 0.40% Fe, 0.7 to 1.1% Cu, 0.1 to 0.5 wt. % Mn, the balance essentially aluminum and incidental elements and impurities.

32. A sheet product in accordance with claim 31 wherein Si is in the range of 0.55 to 0.75 wt. %.

33. An sheet product in accordance with claim 31 wherein Mg is in the range of 0.3 to 0.45 wt. %.

34. A sheet product in accordance with claim 31 wherein Fe is in the range of 0.1 to 0.4 wt. %.

35. Vehicular panel members fabricated from a sheet product consisting essentially of 0.5 to 0.85% Si, 0.25 to 0.48% Mg, 0.05 to 0.40% Fe, 0.7 to 1.1% Cu, 0.1 to 0.5 wt. % Mn, the balance essentially aluminum and incidental elements and impurities.

36. A vehicular panel member in accordance with claim 35 wherein said member is an inner panel formed from said sheet product in mild steel forming dies to produce a deep drawn product having a shape substantially identical to mild steel formed in said dies.

37. A vehicular panel member in accordance with claim 35 wherein said member includes an outer panel.

38. A plural panel vehicular structural member having spaced generally parallel inner and outer panels connected along peripheral portions thereof, said panels comprised of an alloy consisting essentially of 0.5 to 0.85% Si, 0.25 to 0.48% Mg, 0.05 to 0.40% Fe, 0.7 to 1.1% Cu, 0.1 to 0.5 wt. % Mn, the balance essentially aluminum and incidental elements and impurities and said inner panel being deep drawn product and formed in mild steel forming dies to produce said deep drawn product having a shape substantially identical to mild steel formed in said dies.

39. A plural panel vehicular structural member in accordance with claim 38 wherein said panels are connected by hemming in steel hemming dies.

40. In the method of producing shaped vehicular members wherein a sheet product is shaped to produce a panel vehicular structural member, the improvement wherein said sheet product is provided in solution heat treated condition as an alloy consisting essentially of 0.5 to 0.85% Si, 0.25 to 0.48% Mg, 0.05 to 0.40% Fe, 0.7 to 1.1% Cu, 0.1 to 0.5 wt. % Mn, the balance essentially aluminum and incidental elements and impurities.

* * * * *